US007789619B2

(12) United States Patent
Durand et al.

(10) Patent No.: US 7,789,619 B2
(45) Date of Patent: Sep. 7, 2010

(54) DEVICE FOR ATTACHING RING SECTORS AROUND A TURBINE ROTOR OF A TURBOMACHINE

(75) Inventors: Didier Noel Durand, Pontault Combault (FR); Dominique Gehan, Paris (FR); Valerie Annie Gros, Grisy Suisnes (FR); Didier Sotto-Lamy, Vaux le Penil (FR)

(73) Assignees: SNECMA, Paris (FR); SNECMA Services, Paris (FR)

( * ) Notice: Subject to any disclaimer, the term of this patent is extended or adjusted under 35 U.S.C. 154(b) by 747 days.

(21) Appl. No.: 11/691,749

(22) Filed: Mar. 27, 2007

(65) Prior Publication Data

US 2007/0231127 A1 Oct. 4, 2007

(30) Foreign Application Priority Data

Mar. 30, 2006 (FR) ..... 06 02746

(51) Int. Cl.
*F01D 11/08* (2006.01)

(52) U.S. Cl. ..... 415/173.1; 415/173.4; 415/174.4; 415/213.1

(58) Field of Classification Search ..... 415/173.1, 415/173.4, 174.4, 213.1
See application file for complete search history.

(56) References Cited

U.S. PATENT DOCUMENTS

| | | | | |
|---|---|---|---|---|
| 4,863,345 | A * | 9/1989 | Thompson et al. | 415/174.1 |
| 5,064,343 | A * | 11/1991 | Mills | 415/173.3 |
| 6,468,026 | B1 * | 10/2002 | Bonnoitt et al. | 415/9 |
| 6,652,226 | B2 * | 11/2003 | Albrecht et al. | 415/173.4 |
| 2004/0047725 | A1 | 3/2004 | Tomita et al. | |

FOREIGN PATENT DOCUMENTS

| | | |
|---|---|---|
| DE | 101 22 464 C 1 | 3/2002 |
| EP | 1 335 113 A1 | 8/2003 |
| EP | 1 455 055 A1 | 9/2004 |
| WO | WO 2005/003520 A1 | 1/2005 |

OTHER PUBLICATIONS

U.S. Appl. No. 11/693,258, filed Mar. 29, 2007, Durand, et al.

* cited by examiner

*Primary Examiner*—Ninh H Nguyen
(74) *Attorney, Agent, or Firm*—Oblon, Spivak, McClelland, Maier & Neustadt, L.L.P.

(57) ABSTRACT

A device for attaching ring sectors around a turbine rotor in a turbomachine is disclosed. Each of the ring sectors includes at its upstream end a circumferential rim being able to be held on an annular casing rail by an annular locking member, and at its downstream end a pressing part that can press axially against a fixed element of the turbine to prevent the upstream rim of the ring sector from disengaging from the locking member in the event of considerable wear of the rail.

12 Claims, 2 Drawing Sheets

DEVICE FOR ATTACHING RING SECTORS AROUND A TURBINE ROTOR OF A TURBOMACHINE

The present invention relates to a device for attaching ring sectors around a turbine rotor in a turbomachine, such as an aircraft turbojet or turboprop in particular.

BACKGROUND OF THE INVENTION

A turbomachine turbine comprises several stages each including a guide vane element formed in an annular array of fixed blades supported by a casing of the turbine and a rotor mounted so as to rotate downstream of the guide vane element in a cylindrical or frustoconical envelope formed by ring sectors attached circumferentially end-to-end to the turbine casing.

The ring sectors comprise at their upstream ends circumferential rims engaged with a slight axial clearance in a radially inner annular groove of an annular casing rail and held radially in this groove by a C-section annular locking member that is engaged axially from upstream on the casing rail and on the circumferential rims of the ring sectors. These sectors are held axially by abutment of their circumferential rims on upstream and downstream faces respectively of the groove of the rail.

The rims of the ring sectors are "decambered" relative to the casing rail and the locking member, that is to say that the rims of the ring sectors have a radius of curvature greater than that of the casing rail and of the locking member, which makes it possible to mount the rims of the ring sectors with a certain radial prestress between the bottom of the groove of the rail and the locking member and thereby to limit the axial movements of the rims of the ring sectors in the groove.

In operation, the differential thermal expansions of the ring sectors and of the casing cause an increase of this radial prestress that is applied in isolated zones of contact between the rims of the ring sectors and the casing rail. But this prestress disappears progressively over time by wear of the rims of the ring sectors and of the casing in these zones of contact. When this radial prestress is zero, the rims of the ring sectors may move axially in the groove of the casing and wear by friction the upstream and downstream faces of the casing groove.

When this wear exceeds a certain value, the rims of the ring sectors may, by moving downstream in the groove, disengage from the locking member, which has the result of tilting the ring sectors toward the axis of the turbine and risking contact between the ring sectors and the turbine rotor, likely to cause destruction of the ring sectors and the rotor.

SUMMARY OF THE INVENTION

A particular object of the invention is to provide a simple, effective and economic solution to this problem.

Accordingly, it proposes a device for attaching ring sectors around a turbine rotor in a turbomachine, each ring sector comprising a frustoconical wall that supports a block of abradable material attached to its inner surface and that comprises at its upstream end a circumferential rim engaged in a radially inner annular groove of an annular casing rail and held radially in this groove by a C-section annular locking member that is engaged axially from upstream on the casing rail and on the circumferential rims of the ring sectors, wherein each ring sector comprises at its downstream end a part that is fitted and attached to the frustoconical wall and to the block of abradable material of the ring sector, this part being able to press axially against a fixed element of the turbine to prevent the upstream rim from disengaging from the wall of the locking member, the axial clearance between the pressing part and the fixed element being less than the axial length of the bearing surface of the upstream rim of the wall on the locking member.

Thanks to the invention, the pressing part provided at the downstream end of each ring sector limits the possible retraction of the upstream rim of the ring sector into the groove of the casing rail and prevents this rim from disengaging from the locking member.

Even in the case of considerable wear of the casing rail, the ring sectors are held axially upstream by their upstream rims pressing on a matching face of the casing rail and downstream by the part pressing on the fixed element.

The pressing part advantageously comprises means that can press radially on the fixed element.

Each ring sector is therefore held in the axial direction and in the radial direction on the fixed element.

According to another feature of the invention, the pressing part is attached to the downstream end of the wall and to the block of abradable material by brazing or welding.

It is advantageous, from the economic point of view, for the pressing part to be on the ring sector, because that prevents modifying the molds for manufacturing these sectors. In addition, the device according to the invention makes it possible to couple ring sectors to a casing rail independently of the wear of the latter.

The axial clearance between the pressing part and the fixed element is less than the axial length of the bearing surface of the upstream rim of the ring sector on the locking member. This makes it possible to ensure that the maximum retraction position of the ring sector is defined by the axial pressure of the part on the fixed element. This axial clearance between the pressing part and the fixed element lies for example between 0.3 and 1.2 mm approximately.

In a preferred embodiment of the invention, the pressing part has an F-shaped section and comprises two rims in a portion of a cylinder that extend in the downstream direction, one of these rims being attached to a radially inner surface of the wall of the ring sector and the other of these rims being able to press radially on a radially outer face of a cylindrical rim of the fixed element.

The fixed element of the turbomachine consists advantageously of a turbine guide vane element situated downstream of the ring sector.

The invention also relates to a turbomachine turbine and a turbomachine, such as an aircraft turbojet or turboprop, comprising at least one device as described above.

Finally, the invention relates to a ring sector for a turbomachine turbine, comprising a frustoconical wall that supports a block of abradable material attached to its inner surface and that comprises at its upstream end a rim for coupling to a casing, which comprises at its downstream end an axial and radial pressing part that is fitted and attached to the wall and to the block of abradable material of the ring sector.

The pressing part is preferably attached by welding or brazing to the block of abradable material and to the downstream end of the wall of the ring sector.

BRIEF DESCRIPTION OF THE DRAWINGS

The invention will be better understood and other features, details and advantages of the latter will appear more clearly on reading the following description, given as a nonlimiting example and with reference to the appended drawings in which.

DESCRIPTION OF THE PREFERRED EMBODIMENTS

Figure 1:
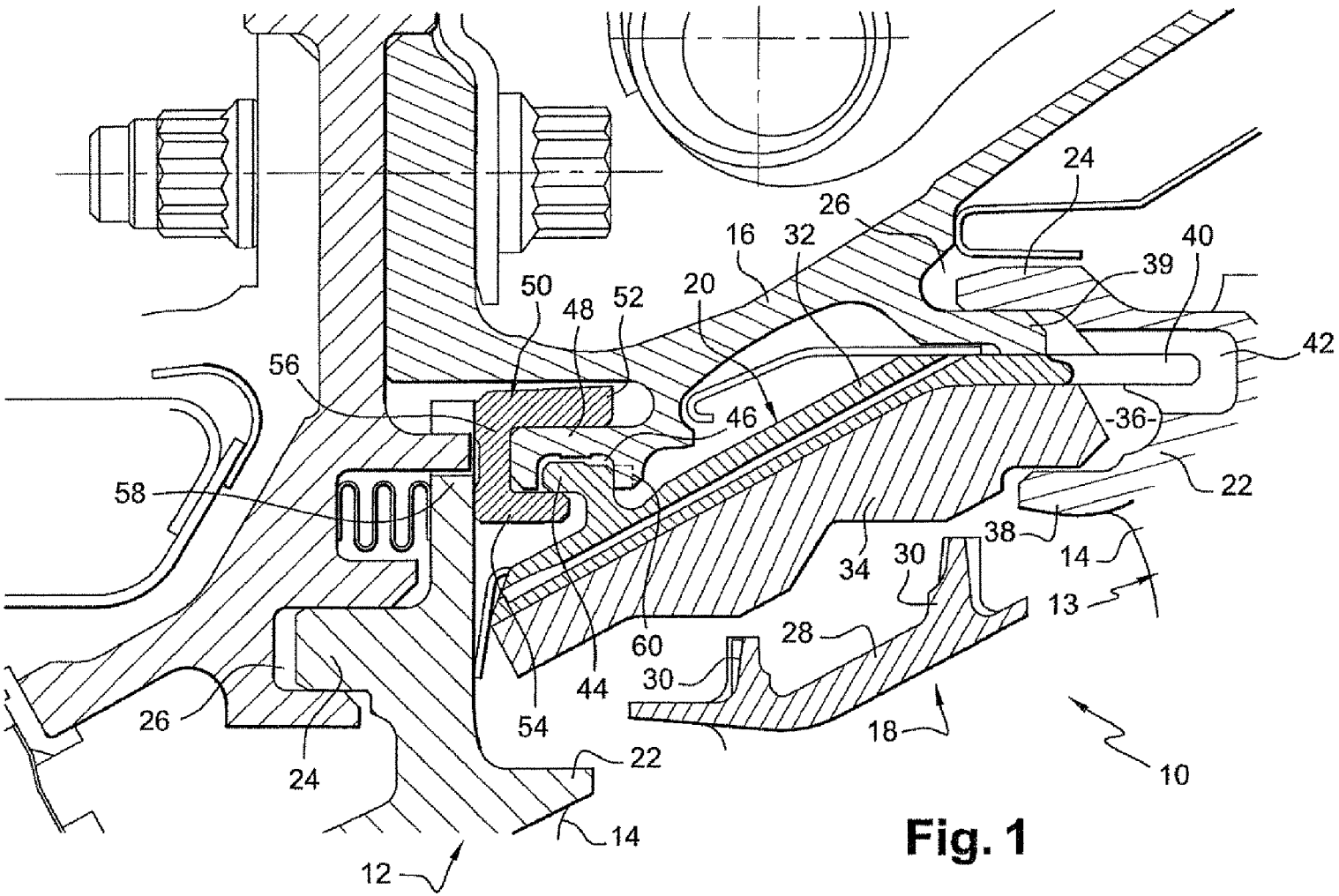
FIG. 1 is a partial schematic view in axial section of a device for attaching ring sectors according to the prior art.

The turbine 10 partially represented in FIG. 1 comprises several stages each including a guide vane element 12, 13 formed of an annular array of fixed blades 14 supported by a casing 16 of the turbine, and a rotor 18 mounted downstream of the guide vane element 12, 13 and rotating in a substantially frustoconical envelope formed by ring sectors 20 supported circumferentially end-to-end by the casing 16 of the turbine.

The guide vane elements 12, 13 comprise an outer wall of revolution 22 and an inner wall of revolution (not visible) respectively, that delimit between them the annular stream of gas flow in the turbine and between which the blades 14 extend radially. The means for attaching the guide vane elements comprise at least one outer cylindrical rim 24 oriented in the upstream direction and designed to be engaged in an annular groove 26 oriented in the downstream direction of the casing 16.

The rotors 18 are supported by a turbine shaft (not shown). They comprise an outer ring 28 and an inner ring (not visible) respectively, the outer ring 28 of each rotor comprising outer annular ribs 30 surrounded externally with a slight clearance by the ring sectors 20.

Each ring sector 20 comprises a frustoconical wall 32 and a block 34 of abradable material attached by brazing and/or welding to the radially inner surface of the wall 32, this block 34 being of the honeycomb type and being designed to wear by friction on the ribs 30 of the rotor to minimize the radial clearances between the rotor and the ring sectors 20.

The downstream ends of the ring sectors 20 are engaged from upstream in an annular space 36 delimited by a cylindrical rim 38 oriented in the upstream direction of the outer wall 22 of the guide vane element 13 situated downstream of the ring sectors, on the one hand, and by a cylindrical rim 39 of the casing to which this guide vane element is coupled, on the other hand.

The ring sectors 20 are held radially at their downstream ends by radial outward pressure of their walls 32 on a radially inner cylindrical face of the rim 39 of the casing, and by radial inward pressure of their blocks 34 of abradable material on a radially outer cylindrical face of the cylindrical rim 38 of the guide vane element.

The walls 32 of the ring sectors each comprise at their downstream ends a lug 40 extending axially in the downstream direction and designed to be engaged in a matching cavity 42 of the downstream guide vane element 13 to prevent the ring sectors 20 from rotating about the axis of the turbine.

The frustoconical walls 32 of the ring sectors 20 also comprise at their upstream ends cylindrical rims 44 oriented in the upstream direction that are engaged with a slight axial clearance in a radially inner annular groove 46 of an annular rail 48 of the casing 16. These rims 44 are held radially in this groove by means of a locking member 50 formed of a C-section split ring engaged from upstream on the annular rail 48 of the casing and on the upstream rims 44 of the ring sectors.

The locking member 50 comprises two cylindrical branches 52 and 54 extending in the downstream direction, radially outer and radially inner respectively, that are connected together at their upstream ends by a radial wall 56, and that are pressed respectively to a radially outer cylindrical face of the rail 48 and to the circumferential rims 44 of the ring sectors 20.

In the example shown, the locking member 50 is prevented from moving axially in the upstream direction by axial pressure of its radial wall 56 on a radial annular rim 58 of the outer wall 22 of the guide vane element 12 situated upstream of the ring sectors 20.

The radius of curvature of the locking member 50 and of the rail 48 is less than that of the rims 44 of the ring sectors 20, which makes it possible to mount with a certain radial prestress the rims 44 of the ring sectors in the groove 46 of the rail, these ring sectors pressing locally on the bottom of the groove and on the radially inner branch 54 of the locking member, respectively.

In operation, the rims 44 of the ring sectors 20 vibrate axially and wear by friction the upstream and downstream faces of the groove 46 of the rail.

When the downstream face of the groove 46 is very worn (as is shown in dashed lines 60), the rims 44 can move in the downstream direction by sliding on the radially inner branch 54 of the locking member, and disengage from the locking member, which may in particular cause the destruction of the blocks 34 of abradable material of the ring sectors that come into contact with the annular ribs 30 of the rotor 18.

The invention makes it possible to provide a simple solution to this problem thanks to a pressing part fitted and attached to the downstream end of each ring sector.

Figure 2:
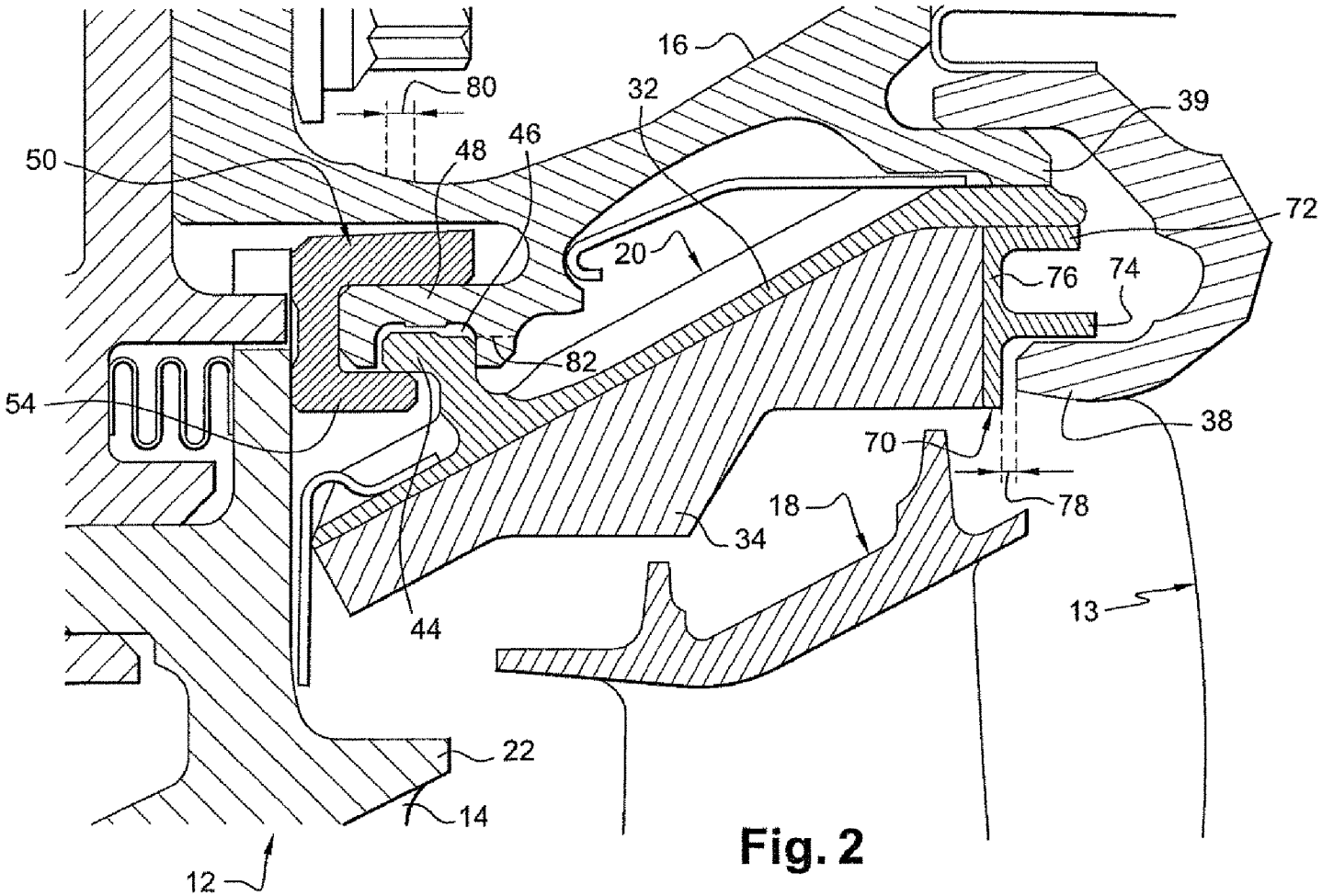
FIG. 2 is a partial schematic view in axial section of a device for attaching ring sectors according to the invention.

In an embodiment of the invention represented in FIG. 2, the pressing part 70 has an F-shaped section and comprises two rims 72 and 74 in a portion of a cylinder oriented in the downstream direction, radially outer and radially inner respectively, that are connected together at their upstream ends by a radial wall 76.

The radially outer face of the outer rim 72 is pressed and attached by welding or brazing to a downstream end portion of the radially inner surface of the wall 32 of the ring sector, and the radial wall 76 is pressed and attached by brazing or welding to a radial face of the block 34 of abradable material of the ring sector 20.

Each ring sector is held radially at its downstream end by radial pressure of the inner rim 74 of the part 70 on the cylindrical rim 38 of the downstream guide vane element, and by radial pressure of its wall 32 on the radially inner face of the cylindrical rim 39 of the casing 16.

The ring sectors are held axially at their upstream ends as described above with reference to FIG. 1, and at their downstream ends by axial pressure in the downstream direction of the radial wall 76 of the part on the upstream end of the cylindrical rim 38 of the downstream guide vane element 13.

The radial walls 76 of the parts 70 are separated from the cylindrical rim 38 of the guide vane element 13 by an axial clearance 78 that is less than the axial length 80 on which the rims 44 of the ring sectors are pressing on the locking member 50, so that, in the event of considerable wear of the downstream face of the groove 46 of the rail, the radial walls 76 of the part 70 come to press axially on the cylindrical rim 38 of the guide vane element and limit the possible retraction of the rims 44 of the ring sectors in the groove, preventing them from disengaging from the locking member 50. The axial clearance lies for example between 0.3 and 1.2 mm approximately.

As long as the casing rail 48 is not worn or is slightly worn, the ring sectors 20 are held axially on the casing 16, as described above with reference to FIG. 1, that is to say by axial pressing of the rims 44 of the ring sectors on the upstream and downstream faces respectively of the groove 46 of the rail.

When the face oriented in the upstream direction of the groove is heavily worn or has even completely disappeared (as shown in dashed lines 82), the ring sectors 20 are held axially in the downstream direction by axial pressure of the radial walls 76 of the parts 70 on the cylindrical rim 38 of the downstream guide vane element.

The part 70 may be fitted and attached to the downstream end of an existing ring sector of the prior art. For this it is sufficient to remove a downstream end portion of the block 34 of abradable material of the ring sector and to attach to it instead by brazing or welding an axial and radial pressing part 70.

As a variant, the pressing part may comprise only axial means of pressing on the upstream rim 38 of the guide vane element, the ring sectors being held radially toward the inside at their downstream ends by radial pressure of the blocks 34 on this upstream rim, as is the case in the prior art.

The invention claimed is:

1. A device for attaching ring sectors around a turbine rotor in a turbomachine, each ring sector comprising:

a frustoconical wall that supports a block of abradable material attached to a radially inner surface of the frustoconical wall;

a circumferential rim disposed at an upstream end of the ring sector which is engaged in a radially inner annular groove of an annular casing rail and held radially in the groove by a C-section annular locking member that is engaged axially from upstream on the casing rail and on the circumferential rims of the ring sectors; and a pressing part disposed at a downstream end of the ring sector that is fitted and attached to the radially inner surface of the frustoconical wall and to the block of abradable material of the ring sector, wherein the part presses axially against a fixed element of the turbine to prevent the upstream circumferential rim from disengaging from the wall of the locking member, and wherein the axial clearance between the pressing part and the fixed element is less than the axial length of a bearing surface of the upstream rim of the wall on the locking member.

2. The device as claimed in claim 1, wherein a portion of the pressing part presses radially on the fixed element.

3. The device as claimed in claim 1, wherein the pressing part is attached to the radially inner surface of the downstream end of the frustoconical wall and to the block of abradable material by brazing or welding.

4. The device as claimed in claim 1, wherein an axial clearance between the pressing part and the fixed element is between 0.3 and 1.2 mm approximately.

5. The device as claimed in claim 1, wherein the pressing part has an F-shaped section.

6. The device as claimed in claim 5, wherein the pressing part comprises first and second rims in a portion of a cylinder that extend in the downstream direction, the first rim being attached to a radially inner surface of the wall of the ring sector and the second rim being able to press radially on a radially outer face of a cylindrical rim of the fixed element.

7. The device as claimed in claim 1, wherein the fixed element forms part of a turbine guide vane element.

8. A turbomachine which comprises at least one device as claimed in claim 1.

9. A turbomachine turbine, which comprises at least one device as claimed in claim 1.

10. The device as claimed in claim 1, wherein a radially inner surface of the pressing part presses against the fixed element of the turbine and a radially outer surface of the pressing part is fitted and attached to the radially inner surface of the frustoconical wall.

11. A ring sector for a turbomachine turbine, comprising:

a frustoconical wall that supports a block of abradable material attached to a radially inner surface of the frustoconical wall;

a rim disposed at an upstream end of the ring sector for coupling to a casing; and an axial and radial pressing part disposed at a downstream end of the ring sector that is fitted and attached to the radially inner surface of the frustoconical wall and to the block of abradable material of the ring sector.

12. The ring sector as claimed in claim 11, wherein the pressing part is attached by welding or brazing to the block of abradable material and to the radially inner surface of the downstream end of the frustoconical wall of the ring sector.

* * * * *